US006115935A

United States Patent [19]

Collins et al.

[11] Patent Number: 6,115,935

[45] Date of Patent: Sep. 12, 2000

[54] BRUSH AND ROLLER SPINNER AND PAINT MIXER

[76] Inventors: Scott Collins, 4504 W. Dunwood Rd., Milwaukee, Wis. 53223; Perry Gartner, 10 Ivy La., Englewood, N.J. 07613

[21] Appl. No.: 09/277,084

[22] Filed: Mar. 26, 1999

[51] Int. Cl.[7] ..... F26B 17/30

[52] U.S. Cl. ..... 34/58; 15/65

[58] Field of Search ..... 34/58; 366/343, 366/276, 279; 15/65; 192/109 R; 411/191, 196, 197, 221; 134/900

[56] References Cited

U.S. PATENT DOCUMENTS

| | | | |
|---|---|---|---|
| 2,794,265 | 6/1957 | Kruger | 34/58 |
| 2,912,769 | 11/1959 | Kruger | 34/58 |
| 5,588,221 | 12/1996 | Hoeltke et al. | 34/58 |
| 5,630,284 | 5/1997 | Huang | 34/58 |

*Primary Examiner*—Henry Bennett
*Assistant Examiner*—Pamela A. Wilson
*Attorney, Agent, or Firm*—Richard A Joel, Esq.

[57] ABSTRACT

A brush and roller spinner and paint mixer comprises a hollow cylindrical body portion, a gripper at one end of the body portion to releasably hold a brush or roller and a handle at the other end of the body portion. The handle is affixed to one end of a helically shaped rod which extends axially through the cylindrical body and is mounted to the gripper member at its other end to cause rotational movement thereof as the handle is moved downwardly. The handle includes a recessed base which extends outwardly from the handle and includes downwardly extending walls having a recess which engages a protrusion on the cylinder cover to halt the motion thereof and lock the handle in place. A paint mixer comprising an elongated shaft with a spiral element at one end may be removably mounted at the other end to the gripper so that the mixer is rotated by movement of the handle.

10 Claims, 4 Drawing Sheets

FIG. 6A
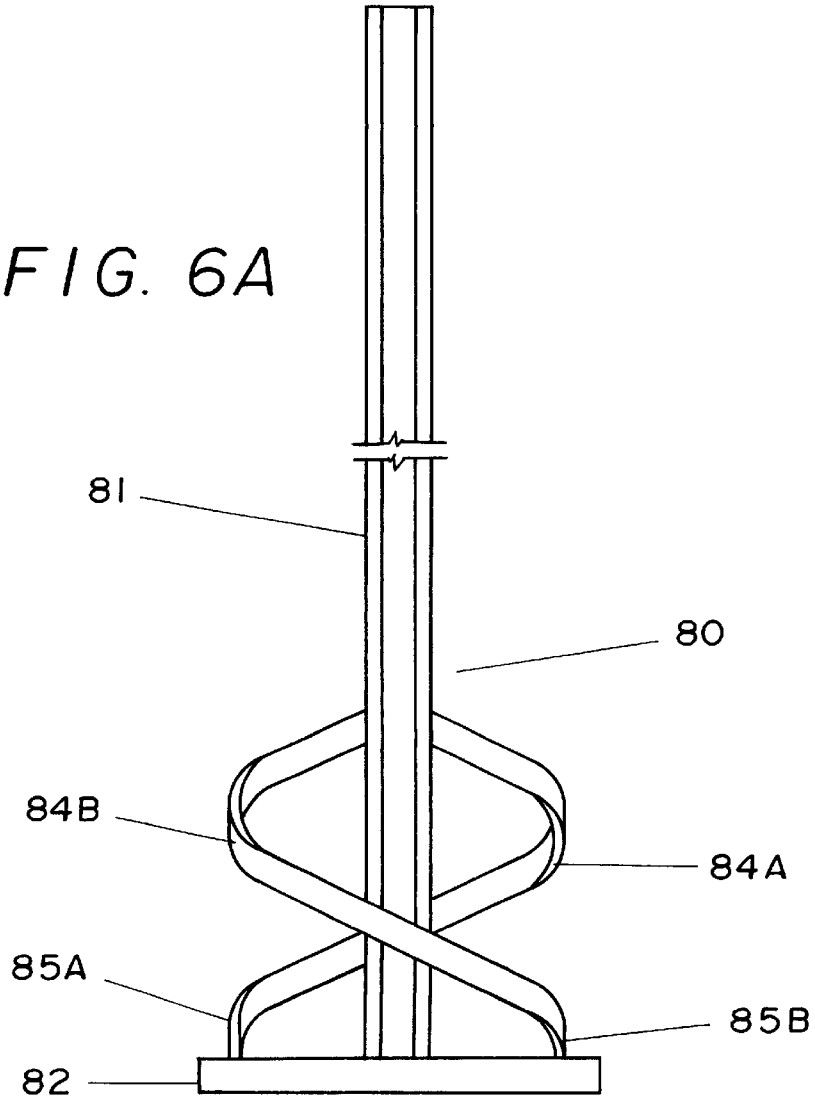
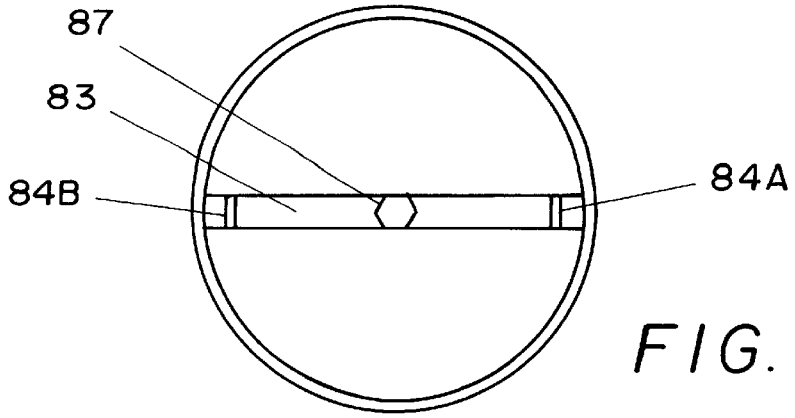
FIG. 6B

BRUSH AND ROLLER SPINNER AND PAINT MIXER

CROSS-REFERENCE TO RELATED APPLICATIONS

NONE

STATEMENT REGARDING FEDERALLY SPONSORED RESEARCH OR DEVELOPMENT

NOT APPLICABLE

BACKGROUND OF THE INVENTION

1. Field of the Invention

This invention relates to a paint brush and roller spiner for cleaner purposes which can also function as a paint mixer.

2. Description of the Related Art Including Information Disclosed Under 37 CFR §§1.97–1.98

Various apparatus for cleaning paint brushes have become quite popular. Among the prior art apparatus are those disclosed in Huang U.S. Pat. No. 5,630,284 and Kruger U.S. Pat. No. 2,884,709.

The Huang patent discloses an apparatus for cleaning paint brushes including a cylindrical casing, an inner retainer and an outer retainer, an inner tube, a rectangular transmission plate, a cap, a driving rod, a driven gear and a coupling block wherein the driving rod serves as a stop arm for securing to the cap as the apparatus is used to drive a paint mixing tool.

Kruger U.S. Pat. No. 2,884,709 is an early patent disclosing the basics of a paint brush cleaning apparatus which was cited as a reference in the Huang patent. Essentially, Kruger relates to an apparatus wherein a brush is mounted longitudinally at one end of the apparatus and rotated by a helical push rod which drives a butterfly disc upon thrust of the push rod.

Other patents of interest include Kruger U.S. Pat. Nos. 2,794,265 and 2,912,769.

The present invention, however, includes a unique handle and stop mechanism in a paint brush cleaning apparatus and is superior to existing apparatus. The apparatus may also be used as a paint mixer by mounting a mixer element thereto which is activated by the handle.

SUMMARY OF THE INVENTION

This invention relates to paint brush and roller cleaning apparatus and particularly to such apparatus having a unique handle and drive mechanism. The apparatus may also be used to mix paint.

As noted in the prior art, a paint brush and roller cleaning apparatus comprises a hollow cylindrical body having brush gripping means mounted thereto at one end and a handle extending outwardly at the other end. The handle is coupled to a helical rod which extends through the cylindrical body and rotates the gripping means when the handle is pushed axially in either direction. The handle includes a recessed mounting in the upper portion thereof to press fit a wrench which is used to secure the brush or the shaft of a mixer in the gripping means.

The lower portion of the handle includes a base which is cylindrical in configuration with a top portion extending horizontally outward from the handle downwardly extending walls and an open lower end. The walls include a cut-out or recess which extends upwardly from the lower periphery and then parallel to the base. The cylindrical body includes a cover having an outward projection which engages the cut-out on the cylinder walls to lock the handle in place and halt the movement thereof.

Accordingly, an object of this invention is to provide a new and improved paint brush and roller cleaning apparatus.

Another object of this invention is to provide a new and improved paint brush cleaning apparatus having a unique handle cooperating with the drive mechanism.

Another object of this invention is to provide a new and improved paint mixing apparatus which can also be used to clean brushes and rollers.

A more specific object of this invention is to provide a novel paint brush cleaning and paint mixing apparatus including a unique handle having means for securing a wrench thereto and locking means for engaging the cap on the cylindrical body to prevent further rotational movement of the drive means for the paint brush, said drive means being rotated by the handle to dry a paint brush or roller or to mix paint at the end opposite handle.

BRIEF DESCRIPTION OF THE DRAWINGS

The above and other objects and advantages of this invention may be more clearly seen when viewed in conjunction with the accompanying drawings wherein:

FIGS. 5*a*, 5*b* and 5*c* illustrate various ways of attaching the spiral driving rod to the handle base; and, FIG. 6*a* is a front view of a mixing element which may be coupled to the apparatus while FIG. 6*b* is a bottom view of the base of the mixer.

DETAILED DESCRIPTION OF THE INVENTION

Figure 1:
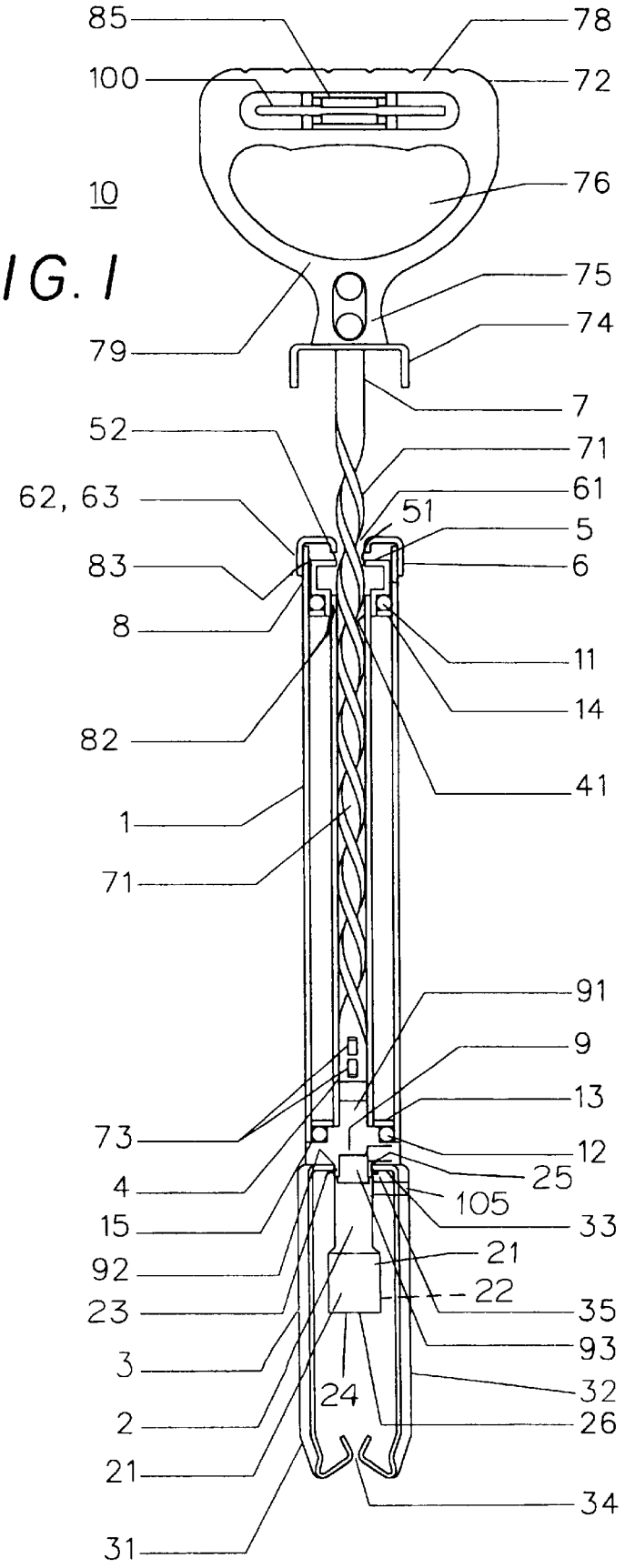
FIG. 1 is a sectional view of the invention embodied in a brush cleaning apparatus.
Figure 2:
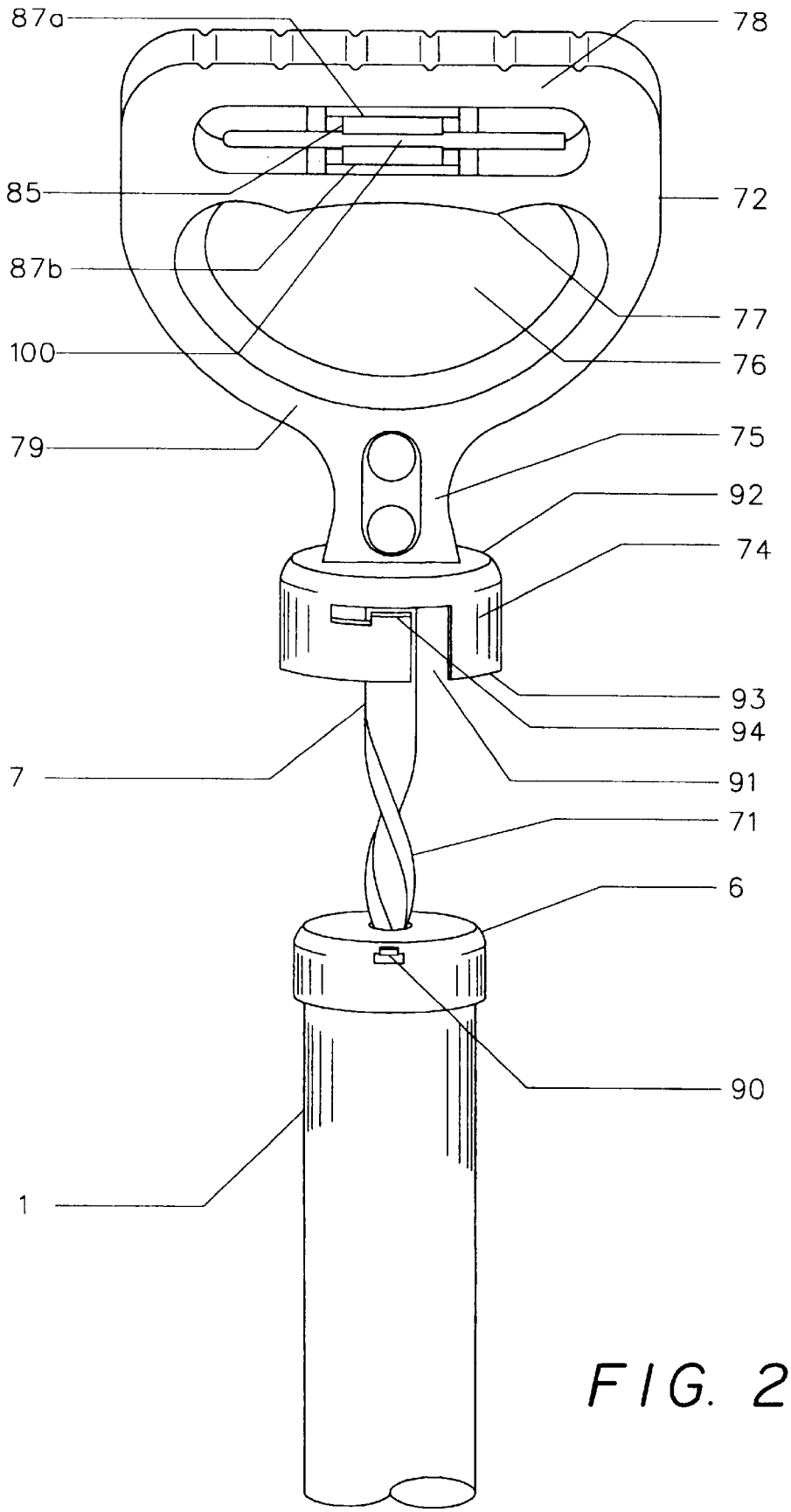
FIG. 2 is a partial perspective view of the invention.
Figure 3:
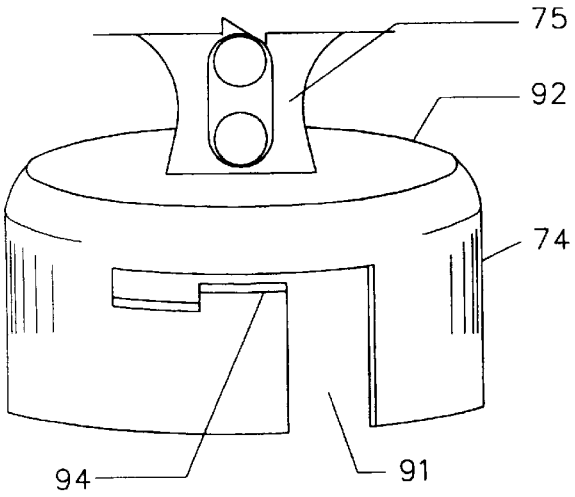
FIG. 3 is an enlarged view of the handle base.
Figure 4:
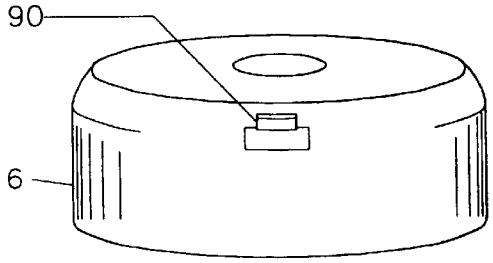
FIG. 4 is an enlarged view of the cylinder cap.

Referring now to FIG. 1 of the drawings, the invention relates a paint brush and roller cleaning and mixer apparatus 10 and particularly to such apparatus having a unique handle design.

The body of the apparatus 10 is similar to that described in U.S. Pat. No. 5,630,284 to Huang. The apparatus 10 comprises a cylindrical casing 1, an inner retainer 2, an outer retainer 3, an inner tube 4, a rectangular transmission plate 5, a cap 6, a driving rod 7, a driven gear 8, and a coupling block 9. The cylindrical casing 1 has two ball bearings 11 and 12 at two opposite ends, each defining a center through hole 13 or 14. The inner retainer 2 is made from a metal plate comprising a flat base 23, two curved projections 21 and 22 extending from the border of the flat base 23 at two opposite sides, a circular mouth 24 defined between the front ends of the curved projections 21 and 22 and a center coupling hole 25 at the center of the flat base 23. The outer retainer 3 is made from a metal plate comprising a flat base 33, two backward projections 31 and 32 respectively extending from the border of the flat base 23 at two opposite sides, a mouth 34 defined between two opposite ends of the backward projection 31 and 32, and a center coupling hole 35 at the center of the flat base 23. The rectangular transmission plate 5 comprises four triangular teeth 51 outwardly projected from the four corners at the same plane, and a center through hole 52. The driven gear 8 comprises a coupling portion 82, and four teeth 83 equiangularly spaced at an opposite side.

The driving rod 7 comprises a helical rod 71 in the middle, a handle 72 at one end, and a plurality of raised portions 73 at the opposite end. The raised portions 73 are made after the driving rod 7 is inserted through the center through hole 61 of the cap 6 and the center through hole 52 of the rectangular transmission plate 5. Therefore, when the raised portions 73 are made, the cap 6 and the rectangular transmission plate 5 are prevented from escaping out of the driving rod 7. The coupling block 9 has two pins 91 and 92 at two opposite ends. When the inner retainer 2 and the outer retainer 4 are respectively mounted around the pin 92 of the coupling block 9 by the respective coupling holes 25 and 35, the pin 92 is hammered down to form a head, and therefore the inner retainer 2 and the outer retainer 3 are secured to the coupling block 9. When the inner retainer 2 and the outer retainer 3 are fastened to the coupling block 9, the mouths 24 and 34 are aligned. When the pin 91 of the coupling block 9 is welded to the inner tube 4, and therefore the inner retainer 2, the outer retainer 3, the coupling block 9, and the inner tube 4 are fixed together to form a chuck. The inner tube 4 has an outer thread 41 at one end remote from the coupling block 9. Steel balls 15 are respectively mounted in the ball bearings 11 and 12 of the cylindrical casing 1, then the chuck (inner tube 4 with retainers 2 and 3) is inserted through the center through holes 13 and 14 of the ball bearings 11 and 12 and then the inner thread 81 of the driven gear 8 is threaded on to the outer thread 41 of the inner tube 4 and then the driving rod 7 is inserted into the inner tube 4, permitting the teeth 51 of the rectangular transmission plate 5 to be respectively engaged with the teeth 83 of the driven gear 8, and then the cap 6 is welded to the cylindrical casing 1.

When in use, the cylindrical casing 1 is held in one hand, the handle 72 of the driving rod 7 is pulled outward with the other hand. When the driving rod 7 is pulled out of the cylindrical casing 1, the rectangular transmission plate 5 is driven by the helical rod section 71 of the driving rod 7 to turn the chuck. When the handle 72 of the driving rod 7 is forced backwards to its former position, the chuck is turned in the reverse direction. A flat paint brush 20 can be fastened to the mouth 34 of the outer retainer 3 and the mouth 24 of the inner retainer 2. A cylindrical paint brush or roller 30 can be mounted around the outer retainer 3. When a paint brush is installed, it is dipped in the solvent, and the chuck is turned back and forth by moving the handle 72 in and out to move the paint brush in the solvent, permitting residual paint to be quickly removed.

The cap 6 includes a projection 90 which engages slot 91 in the base 92 of the handle 72 to lock the driving rod 7 in position. The slot 91 includes a vertical portion extending upwardly from the edge 93 of the base wall 74 and then horizontally along the upper portion at the slot to form a finger 94 projecting outwardly and upwardly adjacent the slot 91 to engage the projection 90 and lock the driving rod 7 in position to prevent movement thereof. The height of the cylindrical wall 74 is determined to provide the appropriate strength.

The handle 72 includes the base 92 with a downwardly extending cylindrical wall 74 which includes the slot 91. The handle 72 which preferably comprises a single molding includes an upwardly extending central portion 75 which flares outwardly and then upwardly to form a gripping aperture 76 with the molding finger locations 77. The upper portion comprises two substantially parallel members 78 and 79 with a central cross member 85. The member 85 includes a horizontal slot 86 with resilient upper and lower members 87*a* and 87*b* which resiliently grip an Allen wrench for purposes of convenience.

Figure 5B:
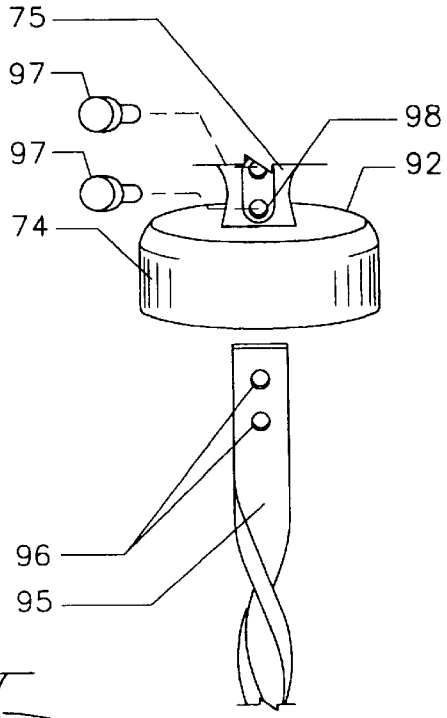
Figure 5A:
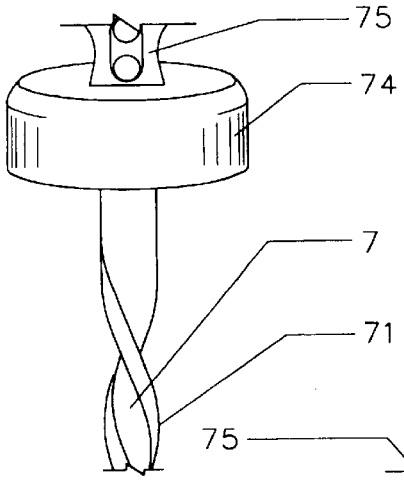
Figure 5C:
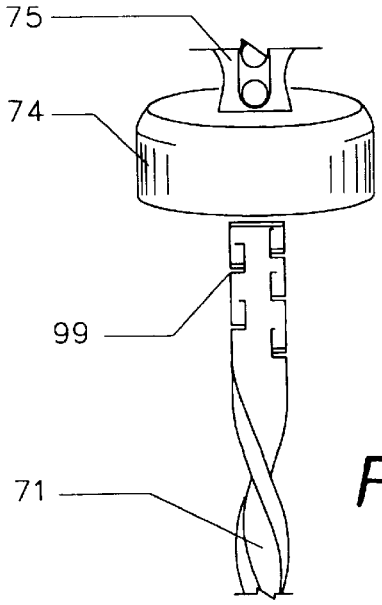

The helical rod 71 may, as shown in FIGS. 5*a–c*, be molded in place (FIG. 5*a*) or riveted in place as shown in FIG. 5*b* with the rod 71 having a flat upper portion 95 with an aperture 96 which extends through the base 73 into the central portion 75 where a rivet 97 is inserted through the mating apertures 96 and 98. In FIG. 5*c* the rod 71 includes a barbed end 99 which may be inserted into an aperture in the central handle portion to attach the parts together.

FIG. 6*a* shows a mixing element 80 which includes a hexagonal elongated shaft 81 at one end and a perpendicular ring 82 having a transverse diametrical element 83 with the shaft 81 mounted to the center 87 thereof. Two spirals 84*a* and 84*b* extend upwardly from the ring 82 to points 85*a* and 85*b* on opposite sides of the shaft 81. The mixer 80 may be mounted to gripping openings 26, 34 by the use of an allen head wrench 100.

In use, the driving rod 7 spins the paint brush held by 47 and 48 in solvent (not shown) as the withdrawn handle 72 is pushed downwardly moving the rod 7 within the cylinder. The brush is also spun as the handle is withdrawn and moved in the opposite direction. When finished, the base 73 engages the cap 6 halting the motion and the handle 72 is turned sideways locking the cap projection 6 in the slot and halting the movement of the handle 72.

The apparatus 10 may be converted to a paint mixer by inserting the hexagonal shaft 81 of element 80 into the gripper apertures 34 and 26. The allen wrench 100 is then used to drive a set screw 105 against the shaft 81 to lock it in place. Movement of the handle 72 causes rotation of the spiral end of the element 80 to permit paint mixing.

While the invention has been explained by a detailed description of certain specific embodiments, it is understood that various modifications and substitutions can be made in any of them within the scope of the appended claims which are intended also to include equivalents of such embodiments.

What is claimed, is:

1. A brush and roller spinner and paint mixer comprises:

a hollow cylindrical body portion;

a gripper at one end of the body portion to releasibly hold a brush or roller;

a handle located at the other end of the cylindrical portion;

a helically shaped rod extending through the cylindrical body portion and having the handle affixed at one end;

having a gripper mounted thereto to the other end to spin the gripper upon movement of the handle;

a cover mounted on the hollow cylindrical portion at the handle end, having downwardly extending sides engaging the cylindrical body and a protrusion extending outwardly therefrom; and, a recessed base on the handle which extends outwardly from the handle and includes downwardly extending walls, said walls having a slot which engages the cover protrusion to halt the motion and lock the handle in position.

2. A brush and roller spinner and paint mixer in accordance with claim 1 wherein:

the slot comprises an aperture extending vertically upwardly on the base wall to a predetermined point and then perpendicular thereto for a predetermined distance 20 to a recess wherein the base includes an upwardly extending finger on the wall between the slot and the recess.

3. A brush and roller spinner and paint mixer in accordance with claim 1 wherein:

the recessed base is molded integrally with the handle.

4. A brush and roller spinner and paint mixer in accordance with claim 1 wherein:

the handle comprises a narrow lower portion affixed to the base and a broader upper portion having a gripping aperture and an upper longitudinal aperture having a tool mounting means.

5. A brush and roller spinner and paint mixer in accordance with claim 4 wherein:

the helical rod includes a barbed end for mounting to the handle.

6. A brush and roller spinner and paint mixer in accordance with claim 4 wherein:

the helical rod is pinned to the handle.

7. A brush and roller spinner and paint mixer in accordance with claim 4 wherein:

the handle includes a gripping aperture having a contoured finger grip along the upper surface thereof.

8. A brush and roller spinner and paint mixer in accordance with claim 4 wherein:

the upper aperture includes resiliently biased sides for mounting allen wrench.

9. A brush and roller spinner and paint mixer in accordance with claim 1 further including:

a mixing element comprising an elongated shaft at one end mounted within the gripper and a ring having spiral mixing means extending upwardly therefrom to engage the shaft, said element being rotated by the handle movement for mixing purposes.

10. A brush and roller spinner and paint mixer in accordance with claim 9 further including:

a set screw actuated by the alien wrench to engage and lock the shaft in place within the gripper.

* * * * *